US012228387B2

(12) United States Patent
Schoetzig et al.

(10) Patent No.: US 12,228,387 B2
(45) Date of Patent: Feb. 18, 2025

(54) IGNITER SYSTEM AND PIECE OF AMMUNITION

(71) Applicant: Rheinmetall Waffe Munition GmbH, Suedheide (DE)

(72) Inventors: Frank Schoetzig, Celle (DE); Julia Strenger, Hamburg (DE); Beate Brauer, Berga (DE); Christopher Zimmermann, Ahrensburg (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 15 days.

(21) Appl. No.: 17/902,087

(22) Filed: Sep. 2, 2022

(65) Prior Publication Data

US 2023/0003497 A1 Jan. 5, 2023

Related U.S. Application Data

(63) Continuation of application No. PCT/EP2021/053877, filed on Feb. 17, 2021.

(30) Foreign Application Priority Data

Mar. 6, 2020 (DE) ..... 10 2020 106 177.3

(51) Int. Cl.
*F42C 19/08* (2006.01)

(52) U.S. Cl.
CPC ..... *F42C 19/0826* (2013.01)

(58) Field of Classification Search
CPC .. F42C 19/08; F42C 19/0807; F42C 19/0815; F42C 19/0823; F42C 19/0826; F42C 19/0834
See application file for complete search history.

(56) References Cited

U.S. PATENT DOCUMENTS 4,917,017 A 4/1990 Beltz
H940 H * 8/1991 Roller ..... 102/470
5,129,324 A * 7/1992 Campoli ..... F42B 5/073 102/470
5,155,295 A * 10/1992 Campoli ..... F42B 5/073 102/431
5,179,250 A * 1/1993 Campoli ..... F42B 5/181 102/431
5,180,883 A 1/1993 Jaskolka et al.
(Continued)

FOREIGN PATENT DOCUMENTS

DE 3442741 A1 5/1986
DE 4041611 A1 6/1992
(Continued)

OTHER PUBLICATIONS

International Search Report dated May 26, 2021 in corresponding application PCT/EP2021/053877.
(Continued)

*Primary Examiner* — Jonathan C Weber
(74) *Attorney, Agent, or Firm* — Muncy, Geissler, Olds & Lowe, P.C.

(57) ABSTRACT

An igniter system for a piece of ammunition, having at least one propellant igniter and at least one igniter element designed for transmitting ignition power and extending away from the propellant igniter. The igniter element is arranged spaced apart from the propellant igniter.

20 Claims, 7 Drawing Sheets

(56) References Cited

U.S. PATENT DOCUMENTS

| | | | | |
|---|---|---|---|---|
| 5,183,961 | A * | 2/1993 | Campoli | F42C 19/0834 102/521 |
| 5,325,785 | A * | 7/1994 | Gardner | F42C 19/0834 102/470 |
| 5,400,715 | A * | 3/1995 | Roach | F42C 19/0834 102/431 |
| 5,443,009 | A | 8/1995 | Thiesen et al. | |
| 5,650,589 | A | 7/1997 | Thiesen | |
| 5,895,881 | A | 4/1999 | Thiesen et al. | |
| 6,600,002 | B2 | 7/2003 | Sanderson et al. | |
| 6,691,621 | B2 * | 2/2004 | Pierrot | F42C 19/0834 102/275.12 |
| 6,708,621 | B1 | 3/2004 | Forichon-Chaumet et al. | |
| 8,122,828 | B2 | 2/2012 | Tedde | |
| 11,248,884 | B2 * | 2/2022 | Orsat | C06C 5/06 |
| 2003/0005847 | A1 * | 1/2003 | Pierrot | F42C 19/0811 102/470 |
| 2010/0212530 | A1 | 8/2010 | Tedde | |

FOREIGN PATENT DOCUMENTS

| | | | | |
|---|---|---|---|---|
| DE | 4318740 | A1 | 12/1994 | |
| DE | 4445989 | A1 | 6/1996 | |
| DE | 10121189 | A1 | 1/2002 | |
| DE | 19944377 | B4 | 8/2006 | |
| EP | 0344098 | A1 | 11/1989 | |
| EP | 0822385 | A1 | 2/1998 | |
| EP | 1092940 | A1 | 4/2001 | |
| EP | 1273875 | A1 * | 1/2003 | F42B 5/16 |
| FR | 2559255 | A1 | 8/1985 | |
| FR | 3002626 | A1 * | 8/2014 | F42B 12/207 |
| WO | WO2009043876 | A2 | 4/2009 | |

OTHER PUBLICATIONS

International Preliminary Report on Patentability dated Sep. 15, 2022 in corresponding application PCT/EP2021/053877.

* cited by examiner

IGNITER SYSTEM AND PIECE OF AMMUNITION

This nonprovisional application is a continuation of International Application No. PCT/EP2021/053877, which was filed on Feb. 17, 2021, and which claims priority to German Patent Application No. 10 2020 106 177.3, which was filed in Germany on Mar. 6, 2020, and which are both herein incorporated by reference.

BACKGROUND OF THE INVENTION

Field of the Invention

The present invention relates to an igniter system for a piece of ammunition, comprising at least one propellant igniter and at least one igniter element designed to transmit ignition power and extending away from the propellant igniter.

Description of the Background Art

The increasingly stricter requirements for the penetration power of kinetic energy ammunition (KE ammunition) requires penetrators which are as long as possible. Since the installation space in large-caliber weapon systems is limited, due to the lowest possible mass of the weapons, the penetrators extend ever farther into the elongated chamber of the weapons. One approach to resolving this situation is the use of shorter propellant igniters, which, however, lead to the increased formation of gas pressure waves, due to the strongly ground-burdening ignition of the propellant charge. The greater the expansion of the propellant charge in the longitudinal direction, the greater are the problems relating to the gas pressure waves. These gas pressure waves may result in leaks between the weapon and the cartridge casing base during firing—i.e., to the escape of hot combustion gases into the combat compartment of the tank—even leading to the destruction of the weapon system.

To counteract these gas pressure waves, an ignition tube running in the middle of the propellant charge was provided in the past, which is connected directly to the propellant igniter and is formed as a structural unit therewith. Ignition tubes of this type extend, for example up to one third of the total length of the propellant charge, and are known, for example, from DE 199 44 377 B4 or from EP 0 822 385 A1, which corresponds to U.S. Pat. No. 5,895,881, and which are all herein incorporated by reference.

Due to the provision of an ignition tube in the conventional art, which is arranged centrally with respect to the center line of the propellant charge and is connected to the propellant igniter, the installation space for longer penetrators has, however, also been limited, so that the latter could not be further elongated. Although the aforementioned approaches have proven to be successful in practice, improvements are nevertheless desirable with respect to the ability to provide longer penetrators.

Dispensing with ignition tubes of this type has, however, not produced the desired result, since the problem with gas pressure waves still remains.

SUMMARY OF THE INVENTION

It is therefore an object of the present invention to provide an igniter system for a large-caliber piece of ammunition, which makes it possible to enlarge the installation space for a penetrator with reduced gas pressure waves.

According to the invention, an igniter system for a piece of ammunition, is provided, which comprises at least one propellant igniter and at least one igniter element designed to transmit ignition power and extending away from the propellant igniter. The igniter element is arranged at a distance from the propellant igniter.

According to the invention, an igniter system for a piece of ammunition is provided. The igniter system comprises at least one propellant igniter, at least one propellant charge and at least one igniter element designed to transmit ignition power to the propellant charge and extending away from the propellant igniter in the propellant charge. The at least one igniter element is arranged at a distance from the propellant charge.

A piece of ammunition can furthermore be provided, which comprises a projectile and an igniter system of this type or refined as described below.

The igniter system may comprise at least one propellant charge, and the igniter element may be designed to transmit ignition power to the propellant charge. The igniter element preferably extends away from the propellant igniter in the propellant charge.

The principle of the invention is based on a short propellant igniter, which takes on the primary ignition or initiation of the propellant charge. In addition to the propellant igniter, at least one igniter element is provided according to the invention, which, due to its structural design (geometric built-in components) and/or due to its constitution (pyrotechnical measures), ignites the propellant charge as uniformly as possible over the entire length of the propellant charge in order to avoid the formation of a gas pressure wave.

By designing the at least one igniter element as a geometric built-in component, the goal is primarily to provide clearances and channels, which make it possible for the flame and the particles of the propellant igniter to reach the front part of the propellant charge from the propellant igniter (at the rear), in order to also ignite the propellant powder in this location. For this purpose, round, oval and/or rectangular channels (tubes), for example, are introduced into the propellant charge for the purpose of ensuring a flame, particle and/or gas transport, with as little turbulence as possible. In the case of fine-grained propellant powders (pourable powders), a through-flow of the propellant powder without pressure waves would not be possible within the necessary firing times, since the propellant powder grains would cause a highly turbulent flow and thereby interfere with the timely ignition in the front part of the propellant charge. These disadvantages are overcome by the igniter system according to the invention.

The at least one igniter element is preferably formed from combustible materials, such as cardboard or cardboard including nitrocellulose and binder. The at least one igniter element may contain pyrotechnic compositions in bound form (e.g., varnish or adhesive), pressed into molded bodies, pyrotechnic compositions in loose bulk form or textile form (pouches), prefabricated pyrotechnic mixtures or propellant powder.

If the flame, hot particles and/or gases generated by the propellant igniter or possibly additionally by the ignition boost charge are merely transmitted, the at least one igniter element may be formed without ignition-boosting substances. In this case, transporting the flame, the at least partially burning particles and/or the hot gases by the at least one igniter element into the regions of the propellant charge at a distance from the propellant igniter is sufficient to ignite the cartridge.

The at least one igniter element may be arranged at a radial distance with respect to the center line of the propellant charge.

The center line is a shared center line of the propellant charge, the propellant igniter, the rotationally symmetrical cartridge casing or cartridge rim, the rotationally symmetrical cartridge casing or cartridge rim and the projectile, as well as the penetrator of the projectile.

The at least one igniter element may be placed at an axially distance from the propellant igniter with respect to a center line of the propellant charge.

The at least one igniter element may be designed as a channel, tube and/or as a cylindrical element.

By transferring the flame, gas and/or particles via the at least one igniter element, the ignition of the propellant charge may be sufficient to safely ignite the cartridge within the required time period with few pressure waves.

It may furthermore be provided that the at least one igniter element extends in the direction of a propellant charge front, preferably at least up to the longitudinal direction center of the propellant charge, in particular up to the front of the propellant charge.

The front of the propellant charge within the meaning of the invention is a region of the frontmost 10% of the propellant charge.

At least one ignition boost charge may be formed separately from the propellant igniter and the at least one igniter element.

If the propellant igniter has too little igniter mass, the ignition boost charge ensures that the ignition power reaches the at least one igniter element.

One or multiple additional ignition boost charges may be used or combined.

The position of the ignition boost charge (igniter or propellant powder in each case) may be situated in the region of the propellant igniter, in ignition transmission channels and/or in the propellant charge.

For the purpose of ignition transmission, rapidly initiatable ignition compositions may be also introduced onto or into the ignition boost charges.

It may also be provided that the igniter element is arranged at a radial distance from the propellant igniter.

It may furthermore be provided that the at least one igniter element is designed to transfer the flame, hot gases and/or particles generated by the propellant igniter and/or by the at least one ignition boost charge. This is done without the formation of an undesirable gas pressure wave.

It may furthermore be provided that the at least one igniter element is designed to generate a flame, hot gases and/or particles.

A better ignition may be achieved if a pyrotechnical flame transfer or transmission takes place in the chamber in addition to the geometric flame transfer by igniter elements, for example in the form of tubes and/or channels, whereby burning particle and/or gases are additionally generated, which may contribute to the transmission of the ignition power—in the front regions as well as the rear regions of the propellant charge.

The at least one igniter element can have a flashover speed or burn-through speed which is higher compared to the propellant charge.

This achieves the fact that the propellant charge is ignited more uniformly.

The igniter elements with active transmission of the ignition power due to pyrotechnic measures should have a higher or at least the same burn-through/flashover speed, compared to the flashover of the propellant powder bed without assistance (geometric built-in components). Ignition mixtures should preferably be used, which react while forming hot particles.

The igniter element can be designed in such a way that the propellant charge is uniformly ignitable over the length of the propellant charge, preferably the entire length of the propellant charge.

This achieves the fact that the propellant charge is ignited as simultaneously and completely as possible. This also prevents a gas pressure wave from forming during the ignition of the propellant charge.

It may furthermore be provided that the at least one ignition boost charge and/or the at least one igniter element is/are designed in the form of an additional black powder, boron-potassium charge and/or igniter charge, in particular in pouch form or encapsulated.

These substances have proven to be particularly resistant to heat and mechanical stress when implementing a particularly fast ignition/flashover. In addition, these substances may form desired sparks with our without metallic additives.

Moreover, the igniter element may have an elongated hollow space. This is one possible embodiment of the igniter element, by means of which it is achieved that the generated flame, the hot gases and/or the particles are transferred.

The piece of ammunition can be a large-caliber piece of ammunition, in particular in a large caliber such as 105 mm, 120 mm, 130 mm, 140 mm or 150 mm. It may also be a piece of ammunition of a different caliber.

The piece of ammunition may preferably be a cartridged piece of ammunition.

The projectile can include a penetrator having a tail unit, the at least one igniter element being arranged in the propellant charge such that it runs through a region between the two adjacent tail unit wings of the tail unit.

Each igniter element can run through a separate region between each of two adjacent tail unit wings.

This achieves the fact that the particular igniter element is arranged in an installation space between two tail unit wings, the igniter element being fastened to the tail unit for mounting the cartridge.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
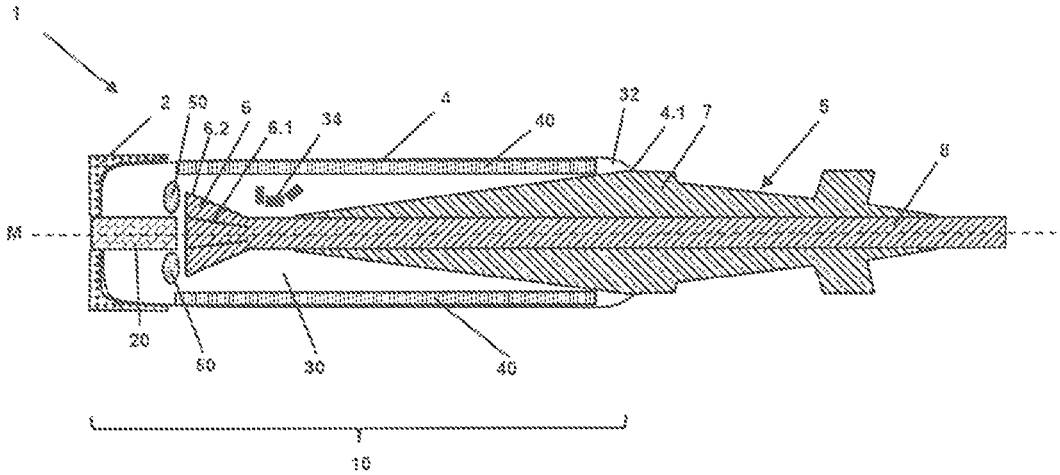
FIG. 1 shows a schematic sectional representation of a piece of ammunition according to the invention, including an igniter system.

A schematic sectional representation of a piece of ammunition 1 according to the invention, including an igniter system 10 according to the invention, is illustrated in FIG. 1.

Igniter system 10 is designed for a piece of ammunition 1, as described above. As is apparent in FIG. 1, the piece of ammunition is a piece of cartridged ammunition 1, preferably a piece of large-caliber cartridged ammunition 1, whose projectile 5 includes a penetrator 8 having a sabot 7. Projectile 5, in particular penetrator 8, includes a tail unit 6. Tail unit 6 includes a plurality of tail unit wings 6.1, 6.2.

Piece of ammunition 1 comprises an igniter system 10 in addition to projectile 5.

According to FIG. 1, piece of ammunition 1 also includes a cartridge casing base 2 and a combustible cartridge casing rim 4. Although this is not illustrated here, cartridge casing base 2 and cartridge casing rim 4 may also be designed as a non-combustible cartridge casing.

Igniter system 10 includes at least one propellant igniter 20. According to FIG. 1, the latter is arranged in cartridge casing base 2.

Igniter system 10 also includes at least one propellant charge 30. Propellant charge 30 is a powder charge formed from a fine-grained or course-grained propellant powder 34.

Igniter system 10 also comprises at least one igniter element 40. Igniter element 40 is designed to transmit ignition power to propellant charge 30. Igniter element 40 extends away from propellant igniter 20 in propellant charge 30. The at least one igniter element 40 is arranged at a distance from propellant igniter 20.

The at least one igniter element 40 is arranged at a radial distance with respect to a center line M of propellant charge 30.

Center line M is a shared center line M of propellant charge 30, propellant igniter 20, cartridge casing base 2, cartridge casing rim 4 and projectile 5 as well as penetrator 8 of projectile 5.

As is apparent from FIG. 1, the at least one igniter element 40 extends in parallel to center line M.

The at least one igniter element 40 is also designed such that it runs along cartridge casing rim 4.

The at least one igniter element 40 is designed as a channel, tube and/or as a cylindrical element. According to FIG. 1, igniter element 40 extends in the direction of the propellant charge front 32, which is situated at an adapter opening 4.1 of cartridge casing rim 4. According to FIG. 1, the at least one igniter element 40 extends up to the region of propellant charge front 32 (the front 10% of propellant charge 30).

At least one ignition boost charge 50 is also formed separately from propellant igniter 20 and igniter element 40. One ignition boost charge 50 is preferably formed for each igniter element 40, which transmits the ignition of propellant charge 30 emerging from propellant igniter 20 to igniter element 40.

As is apparent from FIG. 1, igniter element 40 is arranged at a radial distance from propellant igniter 20.

The at least one igniter element 40 may be designed to transfer the flame, hot gases and/or particles generated by propellant igniter 20 and/or the at least one ignition boost charge 50. Igniter element 40 is provided with a hollow design for this purpose. Igniter element 40 may have an elongated hollow space for this purpose.

The at least one igniter element 40 and/or ignition boost charge 50 is designed to generate a flame, hot gases and/or particles.

The at least one igniter element 40 also has a higher flashover speed or burn-through speed, compared to propellant charge 30, in order to ensure that propellant charge 30 is ignited uniformly not only in the region of propellant igniter 20 but also along the at least one igniter element 40.

For this purpose, igniter element 40 is designed in such a way that propellant charge 30 is uniformly ignitable over the length of propellant charge 30, preferably the entire length of propellant charge 30.

The at least one ignition boost charge 50 and/or the at least one igniter element 40 is/are designed in the form of an additional black powder, boron-potassium charge and/or igniter charge, in particular in pouch form or encapsulated.

Propellant igniter 20 in FIG. 1 is used to ignite propellant charge 30. The output power of propellant igniter 20 is optionally boosted by one or multiple ignition boost charge (s) 50. The flame, hot particles and/or gases generated by propellant igniter 20 and possibly ignition boost charge 50 are used to either ignite igniter elements 40 or to transfer the flame, the hot particles and/or the gases. In the case of active generation of hot particles and/or gases, pyrotechnic substances, mixtures as well as rapidly burning propellant powders and combinations of the two are used.

One or multiple ignition boost charge(s) 50 may be used or combined.

Figure 2:
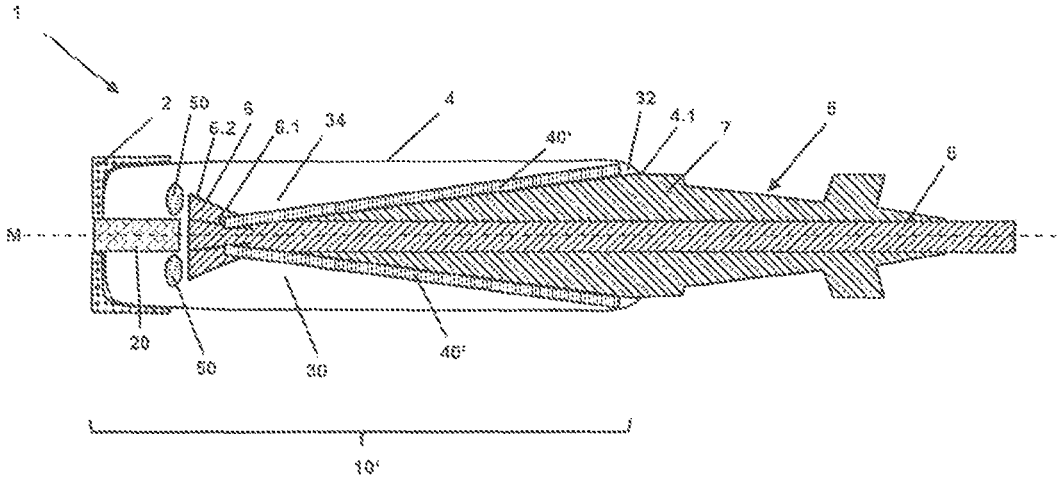
FIG. 2 shows a schematic sectional representation of a piece of ammunition according to the invention, including an igniter system according to the invention.

FIG. 2 shows a schematic sectional representation of a piece of ammunition 1 according to the invention, including an igniter system 10' according to the invention in a second specific embodiment. Igniter system 10' of the second specific embodiment is based on igniter system 10' of the first specific embodiment, only the differences between the second and the first specific embodiment being explained below.

The at least one igniter element 40' does not run in parallel to center line M but extends, in addition to the axial direction, also in a radial direction of center line M. The rear end of the at least one igniter element 40' is arranged closer to center line M than the front end of igniter element 40'. Accordingly, the front end of igniter element 40' is arranged closer to cartridge casing rim 4 than the rear end of igniter element 40'.

As is apparent in FIG. 2, the at least one igniter element 40' is arranged in propellant charge 30 such that it runs through a region between two adjacent tail unit wings 6.1, 6.2. At least one part of the at least one igniter element 40' runs between two adjacent tail unit wings 6.1, 6.2.

As is apparent from FIG. 2, each igniter element 40' runs through a separate region between two adjacent tail unit wings 6.1, 6.2 in each case.

Figure 3:
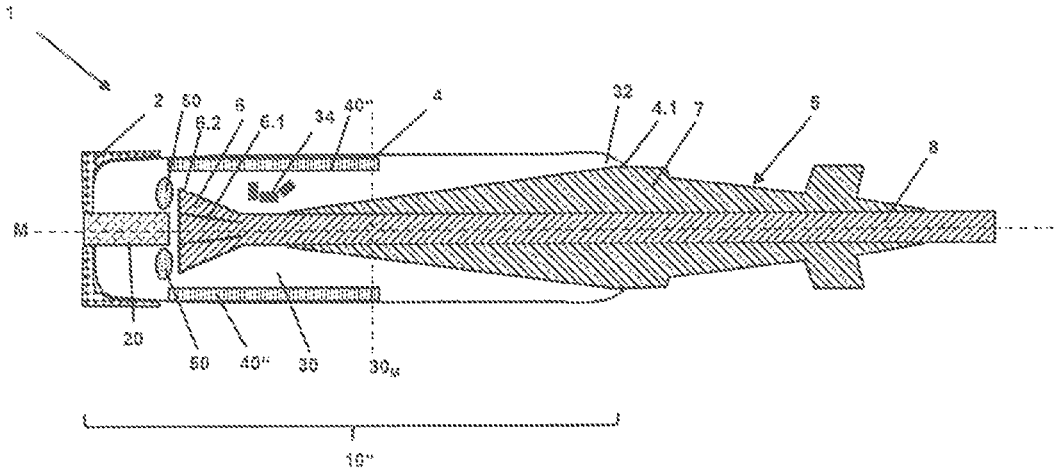
FIG. 3 shows a schematic sectional representation of a piece of ammunition according to the invention, including an igniter system according to the invention.

FIG. 3 shows a schematic sectional representation of a piece of ammunition 1 according to the invention, including an igniter system 10" according to the invention. Igniter system 10" in the third specific embodiment is based on igniter system 10" in the first specific embodiment, only the differences between the third and the first specific embodiment being explained below.

Figure 4:
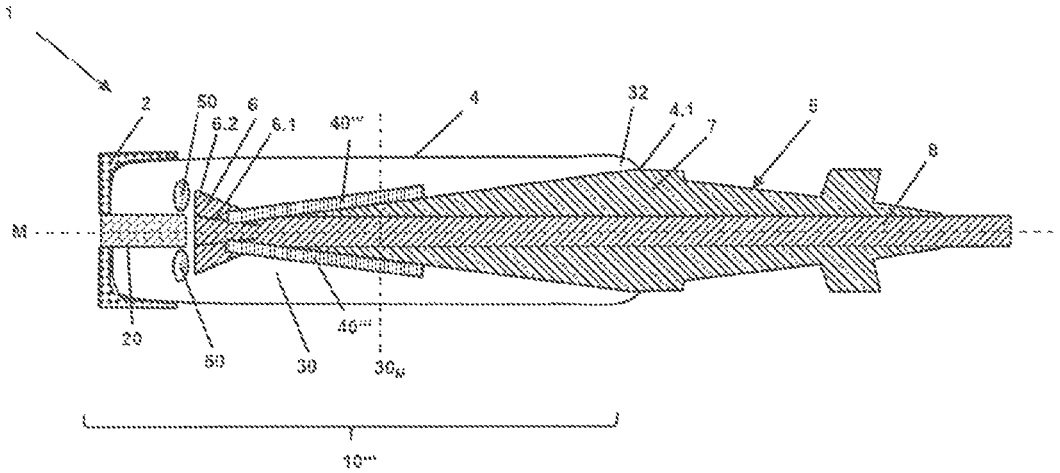
FIG. 4 shows a schematic sectional representation of a piece of ammunition according to the invention, including an igniter system according to the invention.

Igniter element 40" extends in the direction of propellant charge front 32 and at least up to longitudinal direction center $\mathbf{30}_M$ (center of the propellant charge in the longitudinal direction) of propellant charge 30. FIG. 4 shows a schematic sectional representation of a piece of ammunition 1 according to the invention, including an igniter system 10' according to the invention. Igniter system 10'" in the fourth specific embodiment is based on igniter system 10' in the second specific embodiment, only the differences between the fourth and the second specific embodiment being explained below.

Igniter element 40'" extends in the direction of propellant charge front 32 and at least up to longitudinal direction center $\mathbf{30}_M$ of propellant charge 30.

Figure 5:
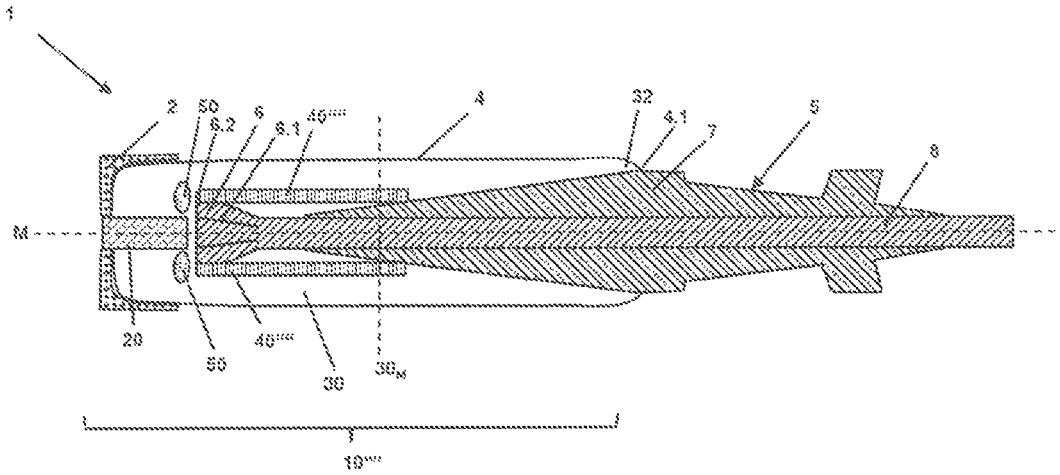
FIG. 5 shows a schematic sectional representation of a piece of ammunition according to the invention, including an igniter system according to the invention.

FIG. 5 shows a schematic sectional representation of a piece of ammunition 1 according to the invention, including an igniter system 10"" according to the invention. Igniter system 10"" in the fifth specific embodiment is based on igniter system 10"" in the third specific embodiment, only the differences between the fifth and the third examples being explained below.

According to the example according to FIG. 5, igniter elements 40"" also run in parallel to center line M. The at least one igniter element 40"" is arranged in propellant charge 30 such that it runs between two adjacent tail unit wings 6.1, 6.2. Each igniter element 40 preferably runs through a separate region between two adjacent tail unit wings 6.1, 6.2 in each case.

Figure 6:
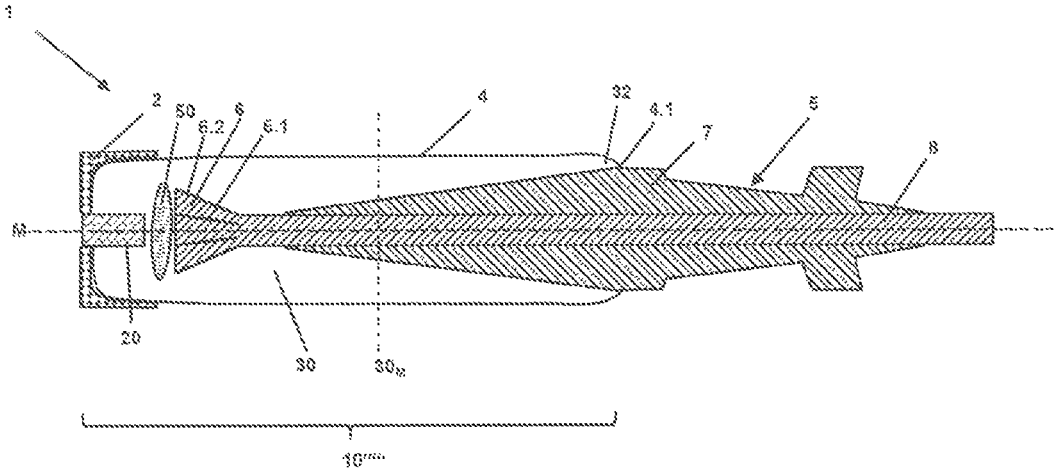
FIG. 6 shows a schematic sectional representation of a piece of ammunition according to the invention, including an igniter system according to the invention.

FIG. 6 shows a schematic sectional representation of a piece of ammunition 1 according to the invention, including an igniter system 10""" according to the invention. Igniter system 10""" may essentially correspond to igniter system 10""" of the first through fifth specific embodiments. Igniter elements 40, 40', 40", 40'", 40"", 40""" are not illustrated in FIG. 6, but they may be designed according to the specific embodiments in FIGS. 1 through 5 or 7. Igniter system 10""" is provided with a different design only with respect to ignition boost charge 50. According to igniter system 10""" in the sixth specific embodiment, only a single ignition boost charge 50 is formed. The latter is arranged on center line M between propellant igniter 20 and tail unit 6. Accordingly, ignition boost charge 50 is designed to be stronger.

Figure 7:
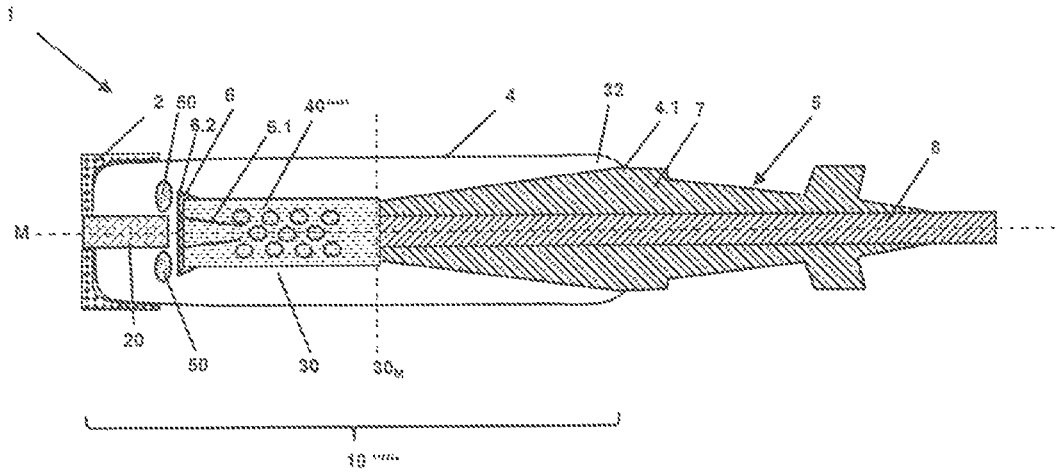
FIG. 7 shows a schematic sectional representation of a piece of ammunition according to the invention, including an igniter system according to the invention.

FIG. 7 shows a schematic sectional representation of a piece of ammunition according to the invention, including an igniter system according to the invention in a first specific embodiment. Igniter system 10"" in the seventh example is based on igniter system 10"" in the fifth example, only the differences between the seventh and the fifth example being explained below.

According to the seventh example, only a single igniter element 40"" is formed, which has a larger diameter than igniter element 40""" in the other specific embodiments. Igniter element 40""" is formed between tail unit 6 of penetrator 8 and sabot 7 and is mounted on penetrator 8.

Igniter element 40""" is formed at a distance from propellant igniter 20.

Igniter element 40""" extends at least up to longitudinal center $\mathbf{30}_M$ of propellant charge 30, preferably beyond it.

An ignition variant is shown in FIG. 7, which combines mechanical strength, compactness as well as a low additional volume with each other.

Igniter element 40""" is designed as a perforated or unperforated tube for transferring the flame, the hot particles and/or the gases, and it may ignite propellant charge 30 without the provision of additional pyrotechnic substances in igniter element 40"". The channel formed by igniter element 40""" alone may carry the ignition in the middle and front regions of propellant charge 30. Alternatively, the hollow space through the tube may be partially or completely filled with pyrotechnic substances and mixtures and/or with propellant powder.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An igniter system for a piece of ammunition, the piece of ammunition comprising a penetrator having a tail unit and a sabot, the igniter system comprising:

at least one propellant igniter;

at least one propellant charge; and at least one igniter element designed to transmit ignition power, which extends away from the propellant igniter, and the at least one igniter element is designed to transmit ignition power to the propellant charge, wherein the at least one igniter element is arranged at a distance from the propellant igniter, wherein the at least one igniter element has a greater flashover speed or burn-through speed, compared to the at least one propellant charge, and wherein the at least one igniter element is arranged on the penetrator between the tail unit and the sabot.

2. The igniter system according to claim 1, wherein the at least one igniter element extends away from the at least one propellant igniter in the at least one propellant charge.

3. The igniter system according to claim 2, wherein the at least one igniter element is arranged at a radial distance with respect to a center line of the at least one propellant charge.

4. The igniter system according to claim 2, wherein the at least one igniter element is situated an axial distance from the at least one propellant igniter with respect to a center line of the at least one propellant charge.

5. The igniter system according to claim 2, wherein the at least one igniter element extends in the direction of a propellant charge front or at least up to the longitudinal direction center of the propellant charge or up to the propellant charge front.

6. The igniter system according to claim 2, wherein the at least one igniter element is designed such that the at least one propellant charge is ignitable uniformly over the length of the at least one propellant charge or over the entire length of the at least one propellant charge.

7. The igniter system according to claim 1, wherein the at least one igniter element is designed as a channel, tube and/or as a cylindrical element.

8. The igniter system according to claim 1, wherein at least one ignition boost charge is formed separately from the at least one propellant igniter and the at least one igniter element.

9. The igniter system according to claim 1, wherein the at least one igniter element is arranged at a radial distance from the at least one propellant igniter.

10. The igniter system according to claim 1, wherein the at least one igniter element is designed to transfer the flame, hot gases and/or particles generated by the propellant igniter and/or the at least one ignition boost charge.

11. The igniter system according to claim 1, wherein the at least one igniter element is designed to generate a flame, hot gases and/or particles.

12. The igniter system according to claim 1, wherein the at least one ignition boost charge and/or the at least one igniter element is/are designed in the form of an additional black powder, boron-potassium charge and/or igniter charger, in particular in pouch form or encapsulated.

13. The igniter system according to claim 1, wherein the at least one igniter element has an elongated hollow space.

14. The igniter system according to claim 1, wherein the igniter element is formed of a combustible material.

15. The igniter system according to claim 1, wherein the igniter element contains pyrotechnic compositions in bound form, pyrotechnic compositions pressed into molded bodies, pyrotechnic compositions in loose bulk form or textile form, prefabricated pyrotechnic mixtures or propellant powder.

16. The igniter system according to claim 1, wherein the igniter element is configured to be empty or filled with a pyrotechnic substance.

17. A piece of ammunition comprising:

a projectile, comprising a penetrator, comprising:

a sabot;

a tail unit; and an igniter system, for a piece of ammunition, the igniter system comprising:

a propellant igniter;

a propellant charge; and an igniter element designed to transmit ignition power, which extends away from the propellant igniter, and the igniter element is designed to transmit ignition power to the propellant charge, wherein the igniter element is arranged at a distance from the propellant igniter, wherein the at least one igniter element has a greater flashover speed or burn-through speed, compared to the at least one propellant charge; and wherein the igniter element is arranged on the penetrator between the tail unit and the sabot.

18. The piece of ammunition according to claim 17, wherein the piece of ammunition is a cartridged piece of ammunition.

19. The piece of ammunition according to claim 17, wherein the igniter element is arranged in the propellant charge such that the igniter element runs through a region between two adjacent tail unit wings of the tail unit.

20. The piece of ammunition according to claim 19, wherein the igniter element is one of a plurality of igniter elements, and wherein each igniter element runs through a separate region between two adjacent tail unit wings in each case.

* * * * *